US005591092A

United States Patent [19]

Gilbert

[11] Patent Number: 5,591,092

[45] Date of Patent: Jan. 7, 1997

[54] GOLF CLUBS WITH GROOVE CONFIGURATION

[75] Inventor: Peter J. Gilbert, Vista, Calif.

[73] Assignee: Acushnet Company, Fairhaven, Mass.

[21] Appl. No.: 438,422

[22] Filed: May 9, 1995

[51] Int. Cl.[6] ..... A63B 53/04

[52] U.S. Cl. ..... 473/330; 473/331

[58] Field of Search ..... 273/77 R, 77 A, 273/167 A, 167 B, 167 C, 167 D, 167 E, 167 F, 167 G, 167 H, 167 J, 167 K, 175, 173, 169; 473/330, 331

[56] References Cited

U.S. PATENT DOCUMENTS

| | | | |
|---|---|---|---|
| 4,529,203 | 7/1985 | Ribaudo | 273/175 |
| 4,754,970 | 7/1988 | Kobayashi | 273/77 A |
| 4,754,971 | 7/1988 | Kobayashi | 273/77 A |
| 4,858,929 | 8/1989 | Long | 273/77 A |
| 5,029,864 | 7/1991 | Keener | 273/77 |
| 5,354,059 | 10/1994 | Stuff | 273/167 J |
| 5,358,249 | 10/1994 | Mendralla | 273/167 J |

OTHER PUBLICATIONS

USGA Rules Of Golf Appendix II, Rule 4–1e.

*Primary Examiner*—Steven Wong
*Attorney, Agent, or Firm*—Pennie & Edmonds

[57] ABSTRACT

An iron golf club set comprising a plurality of clubs with varying lofts and groove spacings, in which the groove spacing of each club is equal to or greater than the groove spacing for the next club in the set with less club loft and there are at least two different groove spacings within the set.

12 Claims, 3 Drawing Sheets

GOLF CLUBS WITH GROOVE CONFIGURATION

BACKGROUND OF THE INVENTION

This invention is directed to golf clubs, and more particularly, a set of golf clubs having a particular groove configuration.

Referring to FIG. 1, a golf club 101 is comprised of a body 102, a toe 106, a heel 107 and a hosel 108. Between the toe 106 and the hosel 107 is a ball striking surface 103. Generally, golf clubs include a plurality of grooves 104 on the striking surface.

The USGA rules have several limitations on the configurations of grooves:

> A series of straight grooves with diverging sides and a symmetrical cross-section may be used. (See diagram.) The width and cross-section must be generally consistent across the face of the club and along the length of the groove. Any rounding of groove edges shall be in the form of a radius which does not exceed 0.020 inches (0.5 mm). The width of the groove shall not exceed 0.035 inches (0.9 mm), using the 30 degree method of measurement on file with the United States Golf Association. The distance between edges of adjacent grooves must not be less than three times the width of a groove, and not less than 0.075 inches (1.9 mm). The depth of a groove must not exceed 0.020 inches (0.5 mm).

United States Golf Association Rule 4-1E. Club Face.

SUMMARY OF THE INVENTION

Broadly, the present invention is directed to a set of iron club heads which have a progressive groove configuration. More particularly, the groove spacing, the distance between grooves, is less than or equal to the groove spacing for the next club with less club loft, and there are at least two different groove spacings throughout the set of irons.

It is a feature of the present invention that the groove spacing is substantially larger for the long irons, 1, 2 and 3 irons, than for the short irons, 9 iron, pitching wedge and sand wedge. In a first embodiment of the invention there are at least three different groove spacings, and preferably, four groove spacings, the groove spacing for each iron being equal to or less than the groove spacing for the next iron with less club loft. In a second embodiment of the present invention, the groove spacing linearly decreases throughout the set of irons to a minimum point, then the groove spacing remains constant throughout the remainder of the set.

In yet another embodiment of the present invention, the groove shape is also progressive. That is, the groove shape for the long irons, e.g., 1, 2, 3 and 4 irons, is substantially V-shaped; the groove shape for the middle irons, e.g., 5, 6 and 7 irons, is substantially trapezoidal-shaped; and the groove shape for the short irons, e.g., 8, 9, pitching wedge, wedge, sand wedge and lob wedge, is substantially square-shaped.

DETAILED DESCRIPTION OF THE PREFERRED EMBODIMENT

Figure 1:
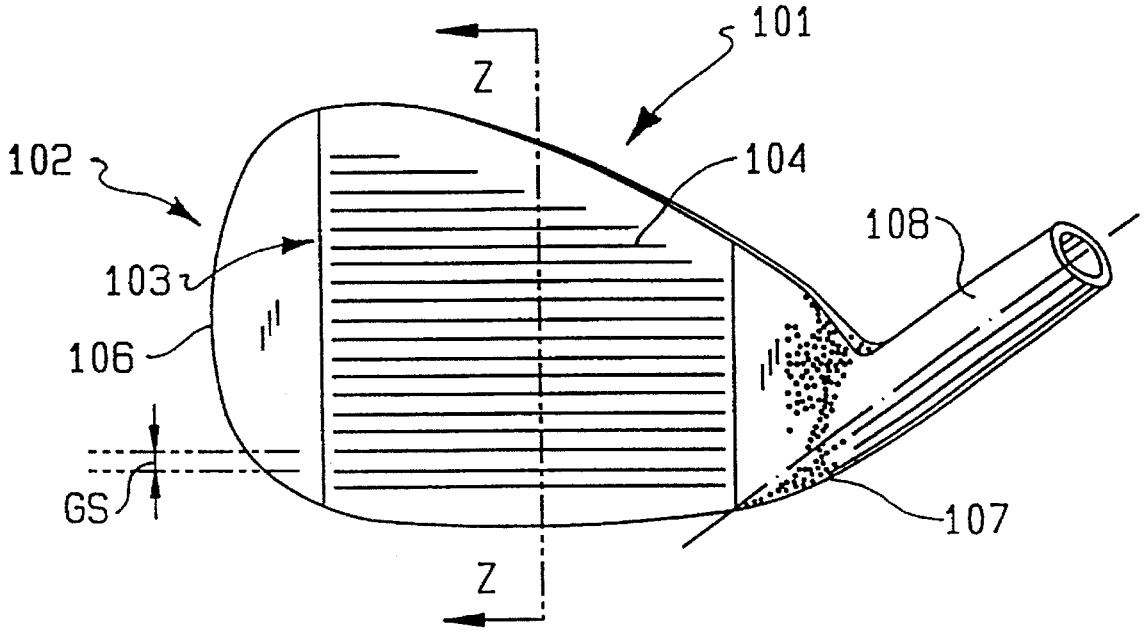
FIG. 1 is a front view of a golf club iron according to the present invention.

FIG. 1 discloses a golf club iron in accordance with the present invention. The iron 101 includes a body portion 102. The body portion 102 of the club includes a toe 106, a heel 107, a hosel 108 and a striking surface 103. On the striking surface there is a plurality of grooves 104. The distance between each groove, measured center to center, is the groove spacing GS. The groove spacing GS remains substantially consistent across the height of the club striking surface.

In this application, "long irons" is defined as the irons with less loft to hit the ball further and is preferably, but not necessarily, the 1–4 irons. The "short irons" are the high lofted clubs and are preferably, but not necessarily, the 8 iron-lob wedge. The "middle irons" are the irons between the long irons and the short irons and are preferably, but not necessarily, the 5–7 irons.

Figure 2:
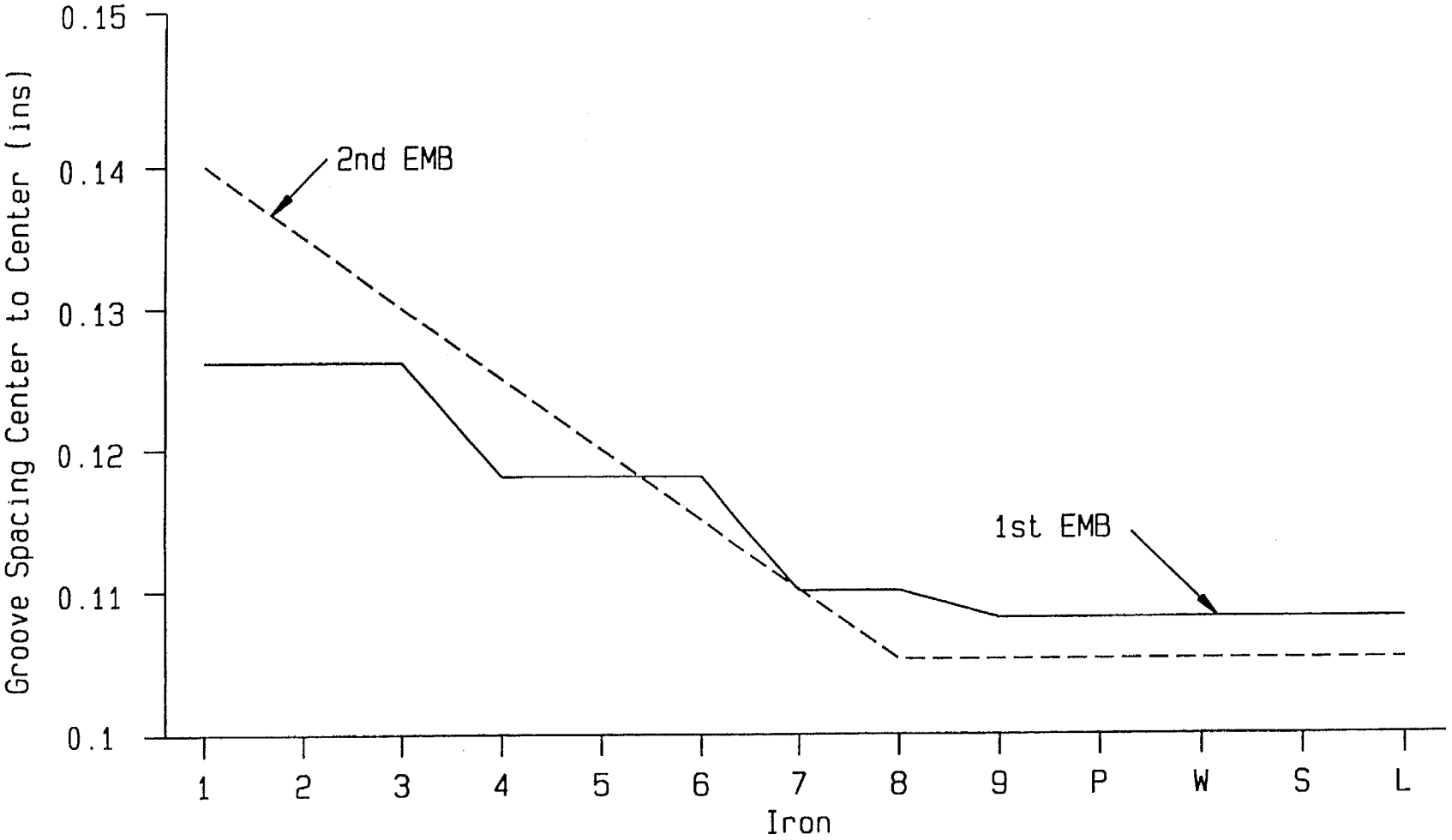
FIG. 2 is a graph of groove spacing versus iron number for the first and second embodiments of golf club sets according to the present invention.

Referring to FIG. 2, a graph of the groove spacing throughout the set of irons for a first embodiment of the present invention and a second embodiment of the present invention is shown. In the first embodiment, the groove spacing for the long irons, the 1, 2 and 3 irons, is approximately 0.126 inches. In the middle irons, the 4, 5 and 6 irons, the groove spacing is approximately 0.118 inches. In the 7 and 8 irons, the groove spacing is approximately 0.110 inches and in the 9 iron through lob wedge, the groove spacing is approximately 0.108 inches. In the second embodiment of the present invention, the groove spacing in the 1 iron is approximately 0.140 inches and the groove spacing decreases by approximately 0.005 inches for each club until the groove spacing is between 0.100 and 0.110, or approximately 0.105, inches for the 8 iron through lob wedge.

In either of these embodiments, the groove spacing for the long irons, such as the 1, 2, 3 and 4 irons, is greater than 0.115 inches. More preferably, the groove spacing for the long irons is between 0.115 inches and 0.150 inches. The groove spacing for the middle irons, such as the 5, 6 and 7 irons, is preferably greater than 0.105 inches and less than 0.125 inches. More preferably, the groove spacing for the middle irons is between 0.110 inches and 0.120 inches. In the preferred embodiment, the groove spacing for the short irons, such as the 8, 9, pitching wedge, wedge, sand wedge and lob wedge, is great enough that the minimum spacing between grooves is greater than the USGA minimum limitation and is less than 0.115 inches. More preferably, the groove spacing for the short irons is between 0.100 inches and 0.110 inches.

Figures 3, 4, 5:
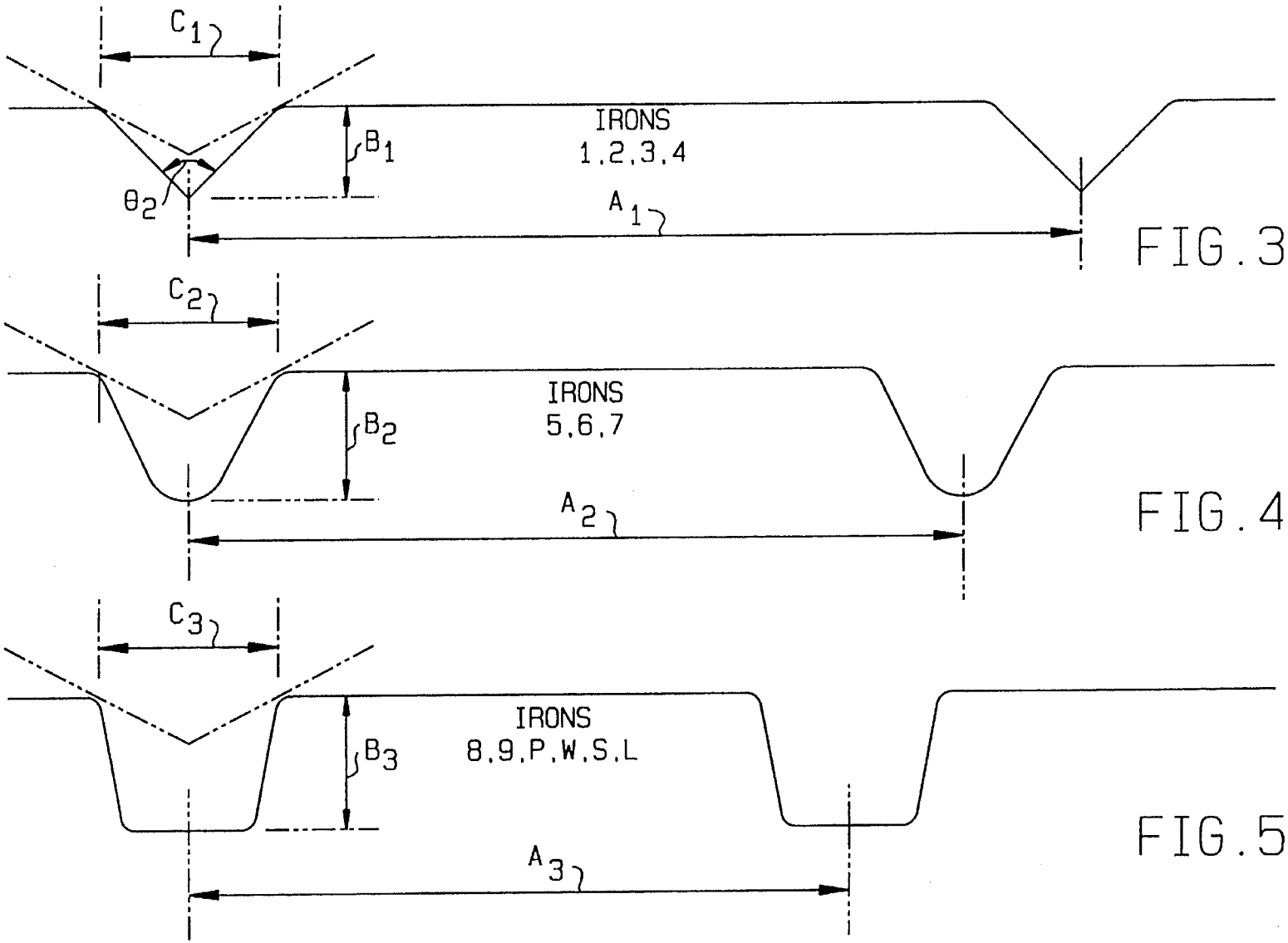
FIG. 3 is a groove pattern for long irons for the third embodiment of the present invention.
FIG. 4 is a groove configuration for middle irons for the third embodiment of the present invention.
FIG. 5 is the groove configuration for short irons for the irons in the present invention.

Referring to FIGS. 3, 4 and 5, various groove patterns for a third embodiment of the present invention are shown. The groove patterns are the patterns that would be seen in the cross-section Z—Z from FIG. 1. The groove spacing A1, for the long irons, A2 for the middle irons and A3 for the low irons are preferably progressive as set forth above. The groove depth, B1, B2 and B3, are less than or equal to the maximum groove depth set by the USGA. The groove width, C1, C2, and C3, are preferably the same and are preferably between 0.024 and 0.027 inches. Most preferably, the groove width is about 0.025–0.026 inches.

Also disclosed in FIGS. 3, 4 and 5, the groove shape throughout the set of irons can be progressive. Groove shape is progressive when the groove volume increases due to shape, i.e., the groove volume for a square-shaped groove is larger than the volume of a V-shaped groove for grooves of the same width, depth and length. Preferably, the groove shape for the long irons is substantially V-shape having a θ2 of approximately 90 degrees. The shape of the middle iron is substantially trapezoidal-shape, and the shape of the groove for the low irons is substantially a square groove. In this embodiment, it is a further characteristic that the groove depth is progressive, i.e., the groove depth increases or remains the same with increased club loft. In the preferred embodiment, the groove depth for the long irons, B1, is approximately 0.014 inches and is substantially less than the groove depth for the middle and low irons, which are preferably approximately 0.020 inches. In another embodiment, the groove depth can gradually increase as the club loft increases and can increase from approximately 0.014 inches to approximately 0.020 inches.

Essentially, groove shape is progressive in that the groove shape for the short irons assists in providing more ball spin than the groove shape for the long irons. This is due to the increased groove volume. It has been found that the square-shaped groove can provide more spin than the V-shaped groove, particularly out of rough. Thus, to be progressive the groove shape preferably goes from no groove or a V-shaped groove to a square-shaped groove. The shape can gradually change or, more preferably, certain shapes are used for a number of clubs as shown in FIGS. 3–5. That is, the 1–4 irons have essentially V-shaped grooves, the 5–7 irons have essentially trapezoidal-shaped grooves or U-shaped grooves and the 8 iron-wedges have essentially square-grooves.

While it is apparent that the invention herein disclosed from the various embodiments will provide many improvements, it will be appreciated that numerous modifications and other embodiments may be made by those of ordinary skill in the art and it is intended that the appended claims cover such modifications and embodiments that will fall within the spirit and scope of the present invention.

I claim:

1. An iron golf club set comprising a plurality of clubs being comprised of club heads having striking faces with varying lofts and groove spacings, in which the groove spacing of each club is equal to or less than the groove spacing for the next club in the set with less club loft and there are at least two different groove spacings within the set, wherein the set is comprised of long irons, middle irons and short irons and the groove spacing for the long irons is between 0.115 inches and 0.15 inches; the striking faces also having varying groove depths, in which the groove depth of each club increases or remains the same as with the next club in the set with less loft and there are at least two different groove depths within the set.

2. The iron golf club set of claim 1, wherein the groove spacing for the middle irons being greater than 0.105 inches and less than 0.125 inches.

3. The iron golf club set of claim 1, wherein the groove spacing for the middle irons is between about 0.110 inches and 0.120 inches.

4. The iron golf club set of claim 1, wherein the groove spacing for the short irons being less than 0.115 inches.

5. The iron golf club set of claim 1, wherein the groove spacing for the short irons is between about 0.100 inches and 0.110 inches.

6. An iron golf club set comprising a plurality of clubs being comprised of club heads having striking faces with varying lofts and groove shapes, in which the groove shape of each club has a volume that increases or remains the same as the next club in the set with less loft and there are at least two different groove shapes within the set.

7. The iron golf club set of claim 6, wherein there are at least three different groove shapes.

8. The iron golf club set of claim 6, wherein the set is comprised of long irons, middle irons and short irons, the groove shape for the long irons being substantially V-shaped, the groove shape for the middle irons being substantially trapezoidal-shaped, and the groove shape for the short irons being substantially square-shaped.

9. The iron golf club set of claim 8, wherein each of the clubs has a groove depth, the groove depth for the long irons being substantially less than the groove depth for the middle and low irons.

10. An iron golf club set comprising a plurality of clubs being comprised of club heads having striking faces with varying lofts and groove depths, in which the groove depth of each club increases or remains the same as with the next club in the set with less loft and there are at least two different groove depths within the set.

11. The iron golf club set of claim 10, wherein the set is comprised of long irons, middle irons and short irons, the groove depth for the long irons being approximately 0.014 inches, the groove depth for the middle irons being approximately 0.020 inches, and the groove depth for the short irons being approximately 0.020 inches.

12. The iron golf club set of claim 10, wherein the groove depths gradually increase with the club loft from approximately 0.014 inches to approximately 0.020 inches.

* * * * *